US007545098B2

(12) United States Patent
Kim

(10) Patent No.: US 7,545,098 B2
(45) Date of Patent: Jun. 9, 2009

(54) PLASMA DISPLAY PANEL INCLUDING ADDRESS ELECTRODE

(75) Inventor: Woo Tae Kim, Yongin-si (KR)

(73) Assignee: LG Electronics, Inc., Seoul (KR)

( * ) Notice: Subject to any disclaimer, the term of this patent is extended or adjusted under 35 U.S.C. 154(b) by 484 days.

(21) Appl. No.: 11/230,474

(22) Filed: Sep. 21, 2005

(65) Prior Publication Data

US 2006/0061279 A1 Mar. 23, 2006

(30) Foreign Application Priority Data

Sep. 21, 2004 (KR) ..... 10-2004-0075693

(51) Int. Cl.
*H01J 17/49* (2006.01)

(52) U.S. Cl. ..... 313/582; 313/583; 313/491; 313/631

(58) Field of Classification Search ..... 313/582–587, 313/491, 631
See application file for complete search history.

(56) References Cited

U.S. PATENT DOCUMENTS 5,742,122 A * 4/1998 Amemiya et al. ..... 313/582
6,522,072 B1 * 2/2003 Yura et al. ..... 313/582
6,703,772 B2 * 3/2004 Hasegawa et al. ..... 313/384
2005/0029939 A1 * 2/2005 Woo et al. ..... 313/582
2005/0029941 A1 * 2/2005 Kwon et al. ..... 313/582
2005/0046353 A1 * 3/2005 Kwon et al. ..... 313/586

FOREIGN PATENT DOCUMENTS

JP 2002-279902 9/2002
JP 2002-324488 11/2002
JP 2003-016944 1/2003

* cited by examiner

*Primary Examiner*—Joseph L Williams
*Assistant Examiner*—Kevin Quarterman
(74) *Attorney, Agent, or Firm*—McKenna Long & Aldridge LLP

(57) ABSTRACT

The present invention relates to a plasma display panel, more particularly to a plasma display panel including an address electrode. A plasma display panel according to the present invention comprises a scan electrode comprising at least one a first hole disposed in the area protruding to the center of a discharge cell; a sustain electrode comprising at least one a second hole disposed in the area protruding to the center of a discharge cell; and an address electrode comprising a third hole formed corresponding to at least one of the first hole or the second hole. The present invention implements an address electrode corresponding to a transparent electrode to enlarge the overlapping size between the two electrodes for improving jitter characteristic and providing two pad transparent electrode having a high efficiency.

15 Claims, 4 Drawing Sheets

Fig. 2 Related Art
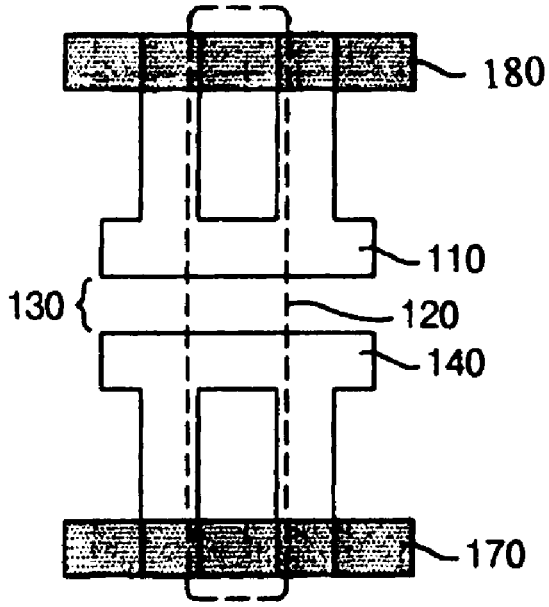
Fig. 3
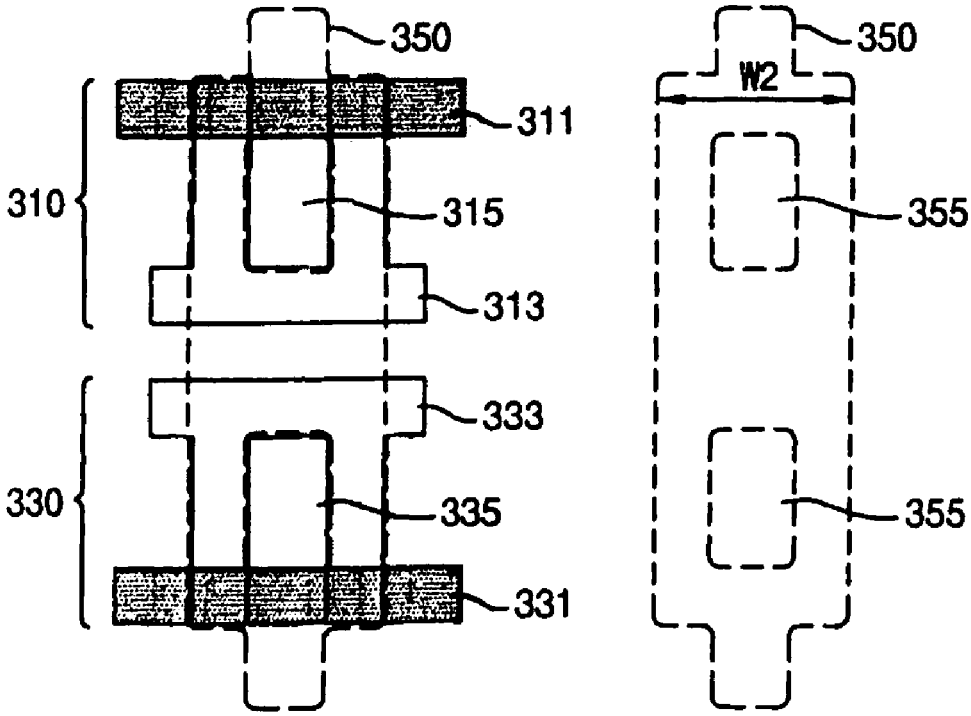

PLASMA DISPLAY PANEL INCLUDING ADDRESS ELECTRODE

This Nonprovisional application claims priority under 35 U.S.C. § 119(a) on Patent Application No. 10-2004-0075693 filed in Korea on Sep. 21, 2004, the entire contents of which are hereby incorporated by reference.

BACKGROUND OF THE INVENTION

1. Field of the Invention

The present invention relates to a plasma display panel, more particularly to a plasma display panel including an address electrode.

2. Description of the Background Art

A plasma display panel (PDP) emits light from a fluorescent body by ultraviolet (UV) rays of 147 nm generated when an inactive mixed gas such as He+Xe, Ne+Xe, or He+Xe+Ne is discharged to display images comprising characters and graphics.

FIG. 1 is a perspective view representing the structure of a plasma display panel of the related art. As shown in FIG. 1, the plasma display panel of related art comprises an upper substrate 10 where a scan electrode 11 and a sustain electrode 12 are formed, and comprises a lower substrate 20 where an address electrode 22 is formed.

Both of the scan electrode 11 and the sustain electrode 12 comprise transparent electrodes 11*a*, 12*a* and bus electrodes 11*b*, 12*b*. Transparent electrodes 11*a*, 12*a* are made of Indium-Tin-Oxide ITO. Bus electrodes 11*b*, 12*b* are made of a metal to reduce resistance.

An upper dielectric layer 13*a* and a protection layer 14 are accumulated on the upper substrate 10 where a scan electrode 11 and a sustain electrode 12 are formed.

Wall charges generated by the plasma discharge are accumulated on the upper dielectric layer 13*a*. The protection layer 14 prevents the upper dielectric layer 13*a* from being damaged by sputtering generated during plasma discharge and improves the efficiency of emitting secondary electrons. MgO is commonly used as the protection layer 14.

A lower dielectric layer 13*b* and a partition wall 21 are formed on the lower substrate 20 where the address electrode X 22 is formed. The surfaces of the lower dielectric layer 13*b* and a partition wall 21 are coated with a fluorescent body layer 23.

The address electrode 22 is formed to intersect the scan electrode 11 and the sustain electrode 12. The partition wall 21 is formed to run parallel with the address electrode 22 to prevent the UV rays and the visible rays generated by discharge from leaking to an adjacent discharge cell.

The fluorescent body layer 23 is excited by the UV rays generated during plasma discharge to generate any one visible ray among red, green, and blue visible rays. An inactive mixed gas is implanted into a discharge space of a discharge cell provided between the upper and lower substrates 10, 20 and the partition wall 21.

FIG. 2 is a plane figure representing the electrode structure of a plasma display panel of the related art. As shown in FIG. 2, the plasma display panel of the related art comprises a first bus electrode 180, a second bus electrode 170, a first transparent electrode 110, a second transparent electrode 140 and an address electrode 120. The area of the first transparent electrode 110 and the second transparent electrode 140 which are adjacent to a discharge gap 130 is still maintained, while a part of the area of the first transparent electrode 110 and the second transparent electrode 140 which are adjacent to the first bus electrode 180 and the second bus electrode 170 is removed. As a result, the discharge efficiency will be increased with a stable firing voltage.

However, the overlapping size between the area of the address electrode 120 and the area of the first transparent electrode 110 and the second transparent electrode 140 having the structure described above decreases. In other words, the overlapping size between the area of the address electrode 120 and the area of the first transparent electrode 110 and the second transparent electrode 140 decreases, because the width of the address electrode 120 is similar to the width of a hole formed in the first transparent electrode 110 and the second transparent electrode 140. As described above, in the plasma display panel of the related art, as the overlapping size between the area of the address electrode 120 and the area of the first transparent electrode 110 and the second transparent electrode 140 becomes smaller, there is a problem in that jitter characteristic decreases resulting in the inadequate performance of addressing.

SUMMARY OF THE INVENTION

Accordingly, an object of the present invention is to solve at least the problems and disadvantages of the background art.

The object of the present invention is to provide a plasma display panel comprising an electrode having the structure capable of increasing a discharge efficiency and enlarging the overlapping size between a transparent electrode and an address electrode.

A plasma display panel according to the present invention comprises a scan electrode comprising at least one first hole disposed in the area protruding to the center of a discharge cell; a sustain electrode comprising at least one second hole disposed in the area protruding to the center of a discharge cell; and an address electrode comprising a third hole formed corresponding to at least one of the first hole or the second hole.

A plasma display panel according to the present invention comprises a scan electrode comprising at least one first hole disposed in the area protruding to the center of a discharge cell; a sustain electrode comprising at least one second hole disposed in the area protruding to the center of a discharge cell; and an address electrode comprising a third hole formed corresponding to at least one of the first hole or the second hole, wherein the width of the address electrode is greater than the width of the first hole and the second hole.

The present invention implements an address electrode corresponding to a transparent electrode to enlarge the overlapping size between the two electrodes for improving the jitter characteristic and providing two highly efficient transparent electrodes.

BRIEF DESCRIPTION OF THE DRAWINGS

The invention will be described in detail with reference to the following drawings in which like numerals refer to like elements.

FIG. 2 is a plane figure representing the electrode structure of a plasma display panel of related art FIG. 3 is a plane figure representing a plasma display panel according to a first embodiment of the present invention.

DETAILED DESCRIPTION OF PREFERRED EMBODIMENTS

Figure 1:
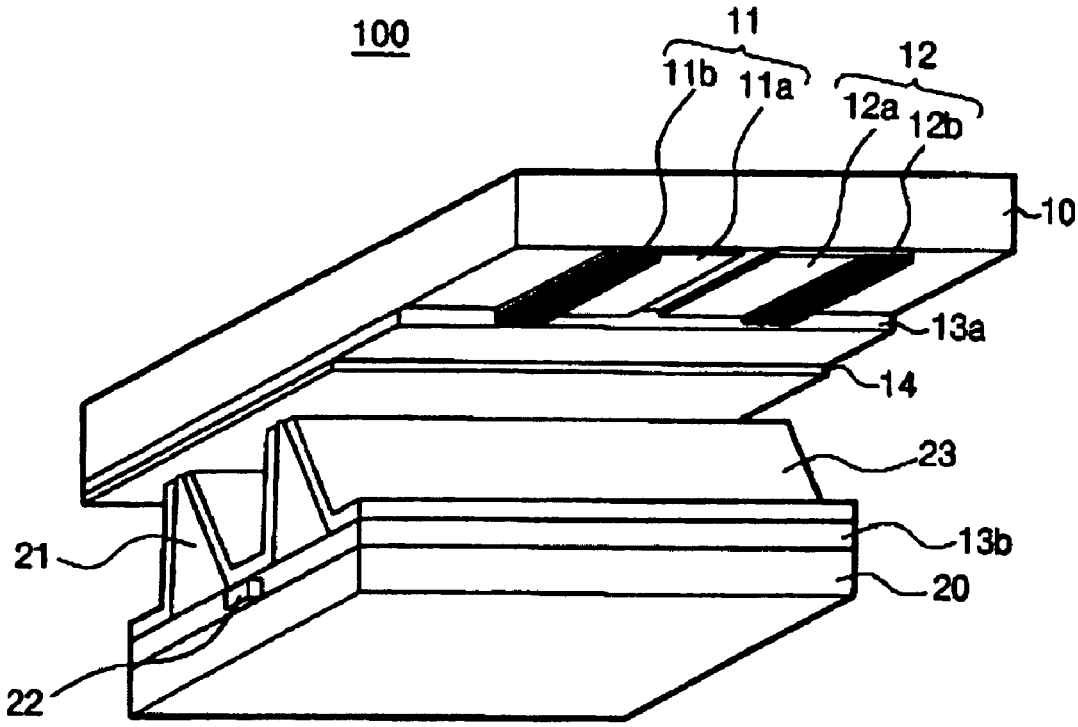
Fig. 1 Related Art
FIG. 1 is a perspective view representing the structure of a plasma display panel of related art.

Preferred embodiments of the present invention will be described in a more detailed manner with reference to the drawings.

A plasma display panel according to the present invention comprises a scan electrode comprising at least one first hole disposed in the area protruding to the center of a discharge cell; a sustain electrode comprising at least one second hole disposed in the area protruding to the center of a discharge cell; and an address electrode comprising a third hole formed corresponding to at least one of the first hole or the second hole.

The scan electrode is formed with a first bus electrode, a first transparent electrode connected with the first bus electrode to form the first hole, wherein the sustain electrode is formed with a second bus electrode, a second transparent electrode connected with the second bus electrode to form the second hole.

The address electrode comprises a third hole separated corresponding to the first hole and the second hole.

The address electrode comprises a third hole formed as one hole corresponding to the first hole and the second hole.

The address electrode comprises the third hole separated corresponding to the first hole and the second hole, wherein the width of non-discharge gap area is greater than the width of the discharge gap area formed by the scan electrode and the sustain electrode.

The address electrode comprises the third hole formed as one hole corresponding to the first hole and the second hole, wherein the width of non-discharge gap area is greater than the width of the discharge gap area formed by the scan electrode and the sustain electrode.

The width of the address electrode is greater than the width of the first hole and the second hole.

A plasma display panel according to the present invention comprises a scan electrode comprising at least one first hole disposed in the area protruding to the center of a discharge cell; a sustain electrode comprising at least one second hole disposed in the area protruding to the center of a discharge cell; and an address electrode comprising a third hole formed corresponding to at least one of the first hole or the second hole, wherein the width of the address electrode is greater than the width of the first hole and the second hole.

The scan electrode is formed with a first bus electrode, a first transparent electrode connected with the first bus electrode to form the first hole, while the sustain electrode is formed with a second bus electrode, a second transparent electrode connected with the second bus electrode to form the second hole.

The address electrode comprises a third hole separated corresponding to the first hole and the second hole.

The address electrode comprises a third hole formed as one hole corresponding to the first hole and the second hole.

The address electrode comprises the third hole separated corresponding to the first hole and the second hole, wherein the width of non-discharge gap area is greater than the width of the discharge gap area formed by the scan electrode and the sustain electrode.

The address electrode comprises the third hole formed as one hole corresponding to the first hole and the second hole, wherein the width of non-discharge gap area is greater than the width of the discharge gap area formed by the scan electrode and the sustain electrode.

Hereinafter, the embodiments of the invention will be described with reference to the following drawings

A First Embodiment

FIG. 3 is a plane figure representing a plasma display panel according to a first embodiment of the present invention. As shown in FIG. 3, a plasma display panel according to the first embodiment of the present invention includes a scan electrode 310, a sustain electrode 330 and an address electrode 350.

The scan electrode 310 comprises at least one first hole 315 disposed in the area protruding to the center of a discharge cell. The scan electrode 310 comprises a first bus electrode 311, a first transparent electrode 313 connected with the first bus electrode 311 to form the first hole 315.

The sustain electrode 330 comprises at least one second hole 335 disposed in the area protruding to the center of a discharge cell. The sustain electrode 330 comprises a second bus electrode 331, a second transparent electrode 333 connected with the second bus electrode 331 to form the second hole 335.

The address electrode 350 comprises a third hole 355 formed corresponding to at least one of the first hole 315 or the second hole 335. The shape of the address electrode 350 is represented in the right side of FIG. 3. The address electrode 350 comprises the third hole 355 separated corresponding to the first hole 315 and the second hole 335. It is preferable that the width of the address electrode 350 w2 is greater than the width of the first hole 315 and the second hole 335.

Accordingly, the plasma display panel according to the first embodiment of the present invention improves a discharge efficiency and enlarges the overlapping size between the electrodes to improve the jitter characteristic and to improve the performance of addressing.

A Second Embodiment

Figure 4:
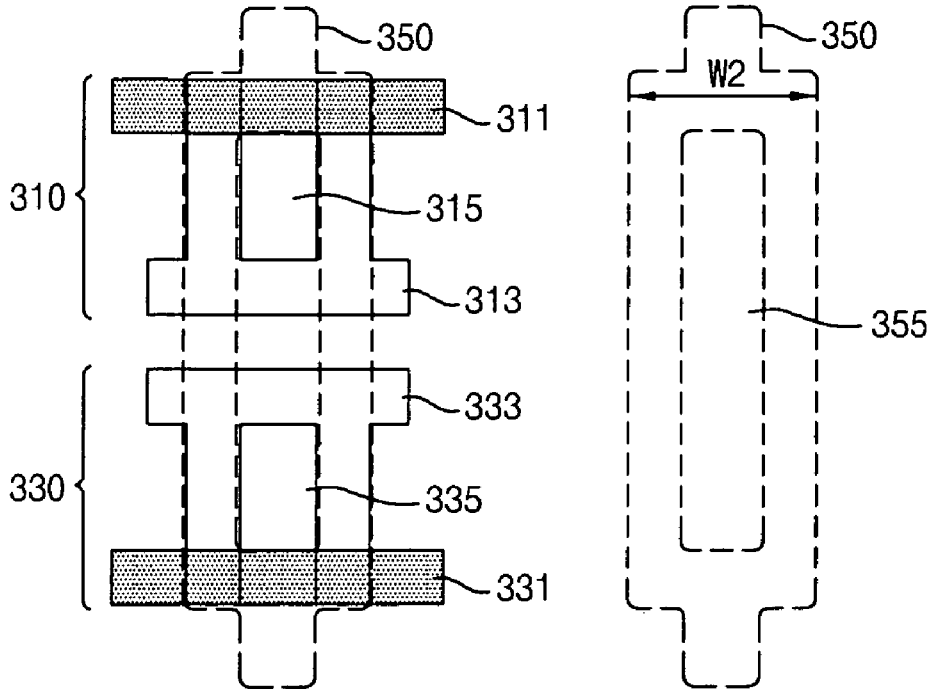
FIG. 4 is a plane figure representing a plasma display panel according to a second embodiment of the present invention.

FIG. 4 is a plane figure representing a plasma display panel according to a second embodiment of the present invention. As shown in FIG. 4, a plasma display panel according to the second embodiment of the present invention includes a scan electrode 310, a sustain electrode 330 and an address electrode 350.

The scan electrode 310 comprises at least one first hole 315 disposed in the area protruding to the center of a discharge cell. The scan electrode 310 comprises a first bus electrode 311, a first transparent electrode 313 connected with the first bus electrode 311 to form the first hole 315.

The sustain electrode 330 comprises at least one second hole 335 disposed in the area protruding to the center of a discharge cell. The sustain electrode 330 comprises a second bus electrode 331, a second transparent electrode 333 connected with the second bus electrode 331 to form the second hole 335.

The address electrode 350 comprises a third hole 355 formed corresponding to at least one of the first hole 315 or the second hole 335. The shape of the address electrode 350 is represented in the right side of FIG. 4. The address electrode 350 comprises the third hole 355 formed as one hole corresponding to the first hole 315 and the second hole 335. It is preferable that the width of the address electrode 350 w2 is greater than the width of the first hole 315 and the second hole 335.

Accordingly, the plasma display panel according to the second embodiment of the present invention improves the discharge efficiency and enlarges the overlapping size between the electrodes to improve the jitter characteristic and to improve the performance of addressing.

A Third Embodiment

Figure 5:
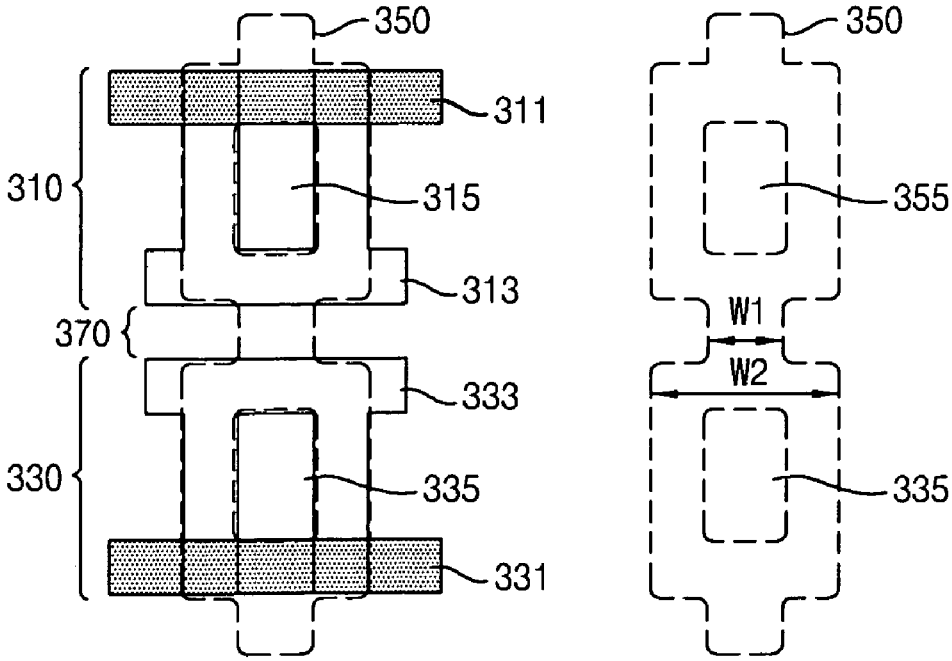
FIG. 5 is a plane figure representing a plasma display panel according to a third embodiment of the present invention.

FIG. 5 is a plane figure representing a plasma display panel according to a third embodiment of the present invention. As shown in FIG. 5, a plasma display panel according to the third embodiment of the present invention includes a scan electrode 310, a sustain electrode 330 and an address electrode 350.

The scan electrode 310 comprises at least one first hole 315 disposed in the area protruding to the center of a discharge cell. The scan electrode 310 comprises a first bus electrode 311, a first transparent electrode 313 connected with the first bus electrode 311 to form the first hole 315.

The sustain electrode 330 comprises at least one second hole 335 disposed in the area protruding to the center of a discharge cell. The sustain electrode 330 comprises a second bus electrode 331, a second transparent electrode 333 connected with the second bus electrode 331 to form the second hole 335.

The address electrode 350 comprises a third hole 355 formed corresponding to at least one of the first hole 315 or the second hole 335. The shape of the address electrode 350 is represented in the right side of FIG. 5. The address electrode 350 comprises the third hole 355 separated corresponding to the first hole 315 and the second hole 335. It is preferable that the width w2 of non-discharge gap area is greater than the width w1 of the discharge gap 370 area of the address electrode 350. It is preferable that the width of the address electrode 350 w2 is greater than the width of the first hole 315 and the second hole 335.

Accordingly, the plasma display panel according to the third embodiment of the present invention improves the discharge efficiency and enlarges the overlapping size between the electrodes to improve the jitter characteristic and to improve the performance of addressing.

A Fourth Embodiment

Figure 6:
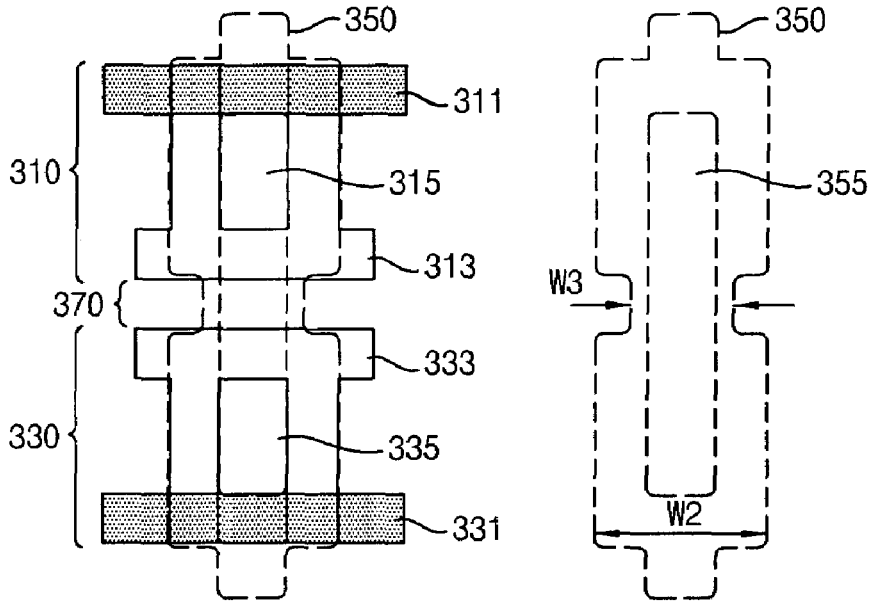
FIG. 6 is a plane figure representing a plasma display panel according to a fourth embodiment of the present invention.

FIG. 6 is a plane figure representing a plasma display panel according to a fourth embodiment of the present invention. As shown in FIG. 6, a plasma display panel according to the fourth embodiment of the present invention includes a scan electrode 310, a sustain electrode 330 and an address electrode 350.

The scan electrode 310 comprises at least one first hole 315 disposed in the area protruding to the center of a discharge cell. The scan electrode 310 comprises a first bus electrode 311, a first transparent electrode 313 connected with the first bus electrode 311 to form the first hole 315.

The sustain electrode 330 comprises at least one second hole 335 disposed in the area protruding to the center of a discharge cell. The sustain electrode 330 comprises a second bus electrode 331, a second transparent electrode 333 connected with the second bus electrode 331 to form the second hole 335.

The address electrode 350 comprises a third hole 355 formed corresponding to at least one of the first hole 315 or the second hole 335. The shape of the address electrode 350 is represented in the right side of FIG. 6. The address electrode 350 comprises the third hole 355 formed as one hole corresponding to the first hole 315 and the second hole 335. It is preferable that the width w2 of non-discharge gap area is greater than the width w1 of the discharge gap 370 area of the address electrode 350. It is preferable that the width of the address electrode 350 w2 is greater than the width of the first hole 315 and the second hole 335.

Accordingly, the plasma display panel according to the fourth embodiment of the present invention improves the discharge efficiency and enlarges the overlapping size between the electrodes to improve the jitter characteristic and to improve the performance of addressing.

A Fifth Embodiment

Figure 7:
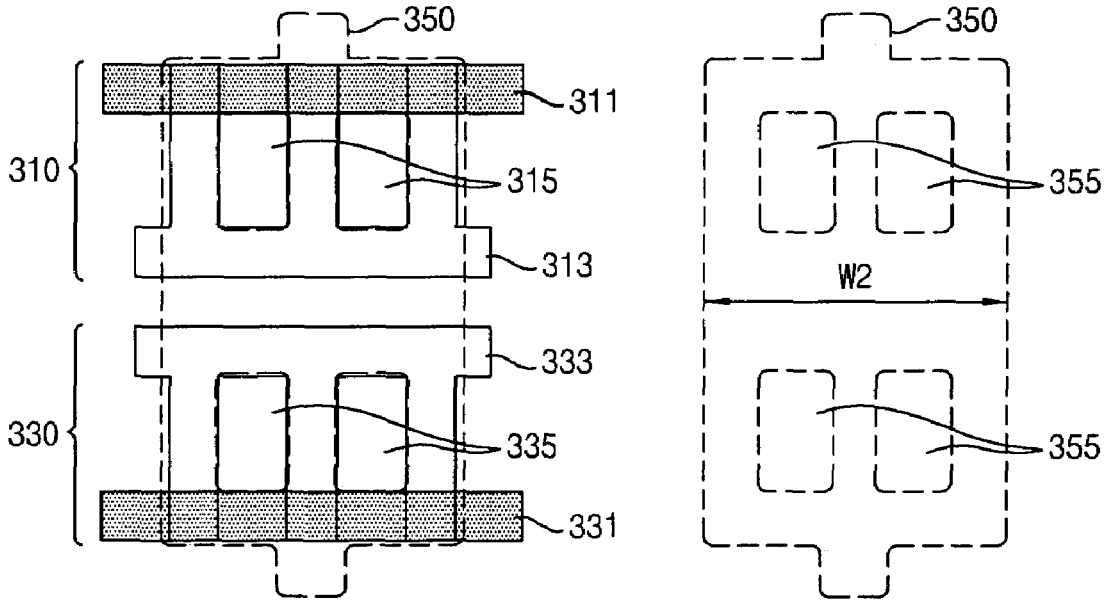
FIG. 7 is a plane figure representing a plasma display panel according to a fifth embodiment of the present invention.

FIG. 7 is a plane figure representing a plasma display panel according to a fifth embodiment of the present invention. As shown in FIG. 7, a plasma display panel according to the fifth embodiment of the present invention includes a scan electrode 310, a sustain electrode 330 and an address electrode 350.

The scan electrode 310 comprises at least two first holes 315 disposed in the area protruding to the center of a discharge cell. In other words, the first hole 315 of the fifth embodiment is plural. The scan electrode 310 comprises a first bus electrode 311, a first transparent electrode 313 connected with the first bus electrode 311 to form the first hole 315.

The sustain electrode 330 comprises at least two a second holes 335 disposed in the area protruding to the center of a discharge cell. In other words, the first hole 315 of the fifth embodiment is plural. The sustain electrode 330 comprises a second bus electrode 331, a second transparent electrode 333 connected with the second bus electrode 331 to form the second hole 335.

The address electrode 350 comprises a third hole 355 formed corresponding to at least one of the first hole 315 or the second hole 335. The shape of the address electrode 350 is represented in the right side of FIG. 7. The address electrode 350 comprises the third hole 355 separated corresponding to the first hole 315 and the second hole 335. It is preferable that the width of the address electrode 350 w2 is greater than the width of the first hole 315 and the second hole 335.

Accordingly, the plasma display panel according to the fifth embodiment of the present invention improves the discharge efficiency and enlarges the overlapping size between the electrodes to improve the jitter characteristic and to improve the performance of addressing.

The invention being thus described may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel comprising:

a scan electrode comprising at least one first hole disposed in the area protruding to the center of a discharge cell;

a sustain electrode comprising at least one second hole disposed in the area protruding to the center of a discharge cell; and an address electrode comprising a third hole faced with the first hole and the second hole.

2. The plasma display panel of claim 1, wherein the scan electrode is formed with a first bus electrode, a first transparent electrode connected with the first bus electrode to form the first hole, wherein the sustain electrode is formed with a second bus electrode, a second transparent electrode connected with the second bus electrode to form the second hole.

3. The plasma display panel of claim 1, wherein the address electrode comprises a third hole separated corresponding to the first hole and the second hole.

4. The plasma display panel of claim 1, wherein the address electrode comprises a third hole formed as one hole corresponding to the first hole and the second hole.

5. The plasma display panel of claim 3, wherein the address electrode comprises the third hole separated corresponding to the first hole and the second hole, wherein the width of the address electrode in non-discharge gap area is greater than the width of the address electrode in the discharge gap area formed by the scan electrode and the sustain electrode.

6. The plasma display panel of claim 4, wherein the address electrode comprises the third hole formed as one hole corresponding to the first hole and the second hole, wherein the width of the address electrode in non-discharge gap area is greater than the width of the address electrode in the discharge gap area formed by the scan electrode and the sustain electrode.

7. The plasma display panel of claim 1, wherein the width of the address electrode is greater than the width of the first hole and the second hole.

8. The plasma display panel of claim 1, wherein a portion of the address electrode faced with the sustain electrode and the scan electrode respectively has a same shape with each other.

9. A plasma display panel comprising:

a scan electrode comprising at least one first hole disposed in the area protruding to the center of a discharge cell;

a sustain electrode comprising at least one second hole disposed in the area protruding to the center of a discharge cell; and an address electrode comprising a third hole formed faced with the first hole and the second hole, wherein the width of the address electrode is greater than the width of the first hole and the second hole.

10. The plasma display panel of claim 9, wherein the scan electrode is formed with a first bus electrode, a first transparent electrode connected with the first bus electrode to form the first hole, wherein the sustain electrode is formed with a second bus electrode, a second transparent electrode connected with the second bus electrode to form the second hole.

11. The plasma display panel of claim 9, wherein the address electrode comprises a third hole separated corresponding to the first hole and the second hole.

12. The plasma display panel of claim 9, wherein the address electrode comprises a third hole formed as one hole corresponding to the first hole and the second hole.

13. The plasma display panel of claim 11, wherein the address electrode comprises the third hole separated corresponding to the first hole and the second hole, wherein the width of the address electrode in non-discharge gap area is greater than the width of the address electrode in the discharge gap area formed by the scan electrode and the sustain electrode.

14. The plasma display panel of claim 12, wherein the address electrode comprises the third hole formed as one hole corresponding to the first hole and the second hole, wherein the width of the address electrode in non-discharge gap area is greater than the width of the address electrode in the discharge gap area formed by the scan electrode and the sustain electrode.

15. The plasma display panel of claim 9, wherein a portion of the address electrode faced with the sustain electrode and the scan electrode respectively has a same shape with each other.

* * * * *